US005193357A

United States Patent [19]

Kohl et al.

[11] Patent Number: 5,193,357

[45] Date of Patent: Mar. 16, 1993

[54] ICE MACHINE WITH IMPROVED EVAPORATOR/ICE FORMING ASSEMBLY

[75] Inventors: Vance L. Kohl, Ladysmith; Mark E. Federspiel, Manitowoc, both of Wis.

[73] Assignee: The Manitowoc Company, Inc., Manitowoc, Wis.

[21] Appl. No.: 721,261

[22] Filed: Jun. 26, 1991

Related U.S. Application Data

[63] Continuation-in-part of Ser. No. 534,926, Jun. 7, 1990, abandoned.

[51] Int. Cl.[5] ..... F25C 1/12

[52] U.S. Cl. ..... 62/347; 62/515

[58] Field of Search ..... 29/890.05; 62/347, 348, 62/352, 515

[56] References Cited

U.S. PATENT DOCUMENTS

| | | | |
|---|---|---|---|
| 2,155,003 | 4/1939 | Benson | 62/126 |
| 2,212,912 | 8/1940 | Booth | 62/126 |
| 2,347,957 | 5/1944 | McCullough | 257/149 |
| 2,359,926 | 10/1944 | McCullough et al. | 29/157.3 |
| 2,415,243 | 2/1947 | Hickman | 62/8 |
| 2,458,686 | 1/1949 | Davie, Jr. | 244/117 |
| 2,716,805 | 9/1955 | Reed | 29/548 |
| 2,934,917 | 5/1960 | Collins | 62/516 |
| 2,997,861 | 8/1961 | Kocker et al. | 62/347 |
| 3,046,753 | 7/1962 | Carapico, Jr. | 62/132 |
| 3,206,944 | 9/1965 | Gallo | 62/347 |
| 3,280,588 | 10/1966 | Brindley | 62/340 |
| 3,495,657 | 2/1970 | Keith | 165/183 |
| 3,668,757 | 6/1972 | Reider | 29/157.3 R |
| 3,827,485 | 8/1974 | Hickman et al. | 165/171 |
| 4,028,795 | 6/1977 | Takahashi et al. | 29/403 |
| 4,033,024 | 7/1977 | Takahashi et al. | 29/403 |
| 4,175,416 | 11/1979 | Fukushima et al. | 72/254 |
| 4,187,711 | 2/1980 | Lavochkin et al. | 72/256 |
| 4,458,503 | 7/1984 | Nelson | 62/347 |
| 4,459,824 | 7/1984 | Krueger | 62/347 |
| 4,510,114 | 4/1985 | Nelson | 264/261 |
| 4,625,378 | 12/1986 | Tanno et al. | 29/157.3 A |
| 4,706,465 | 11/1987 | Searl | 62/137 |
| 4,843,827 | 7/1989 | Peppers | 62/73 |
| 4,947,653 | 8/1990 | Day et al. | 62/73 |
| 4,995,245 | 2/1991 | Chang | 62/347 X |

FOREIGN PATENT DOCUMENTS

| | | | |
|---|---|---|---|
| 142364 | 12/1978 | Japan | 29/890.05 |

*Primary Examiner*—William E. Tapolcai

*Attorney, Agent, or Firm*—William Brinks Olds Hofer Gilson & Lione

[57] ABSTRACT

An improved evaporator/ice forming assembly for an ice machine is disclosed. The assembly comprises evaporator tubing sections having one or more integrally formed fin elements; evaporator system connectors adapted for connecting the tubing sections together to form a sealed evaporator section of a refrigeration system; and divider elements adapted to fit together with the one or more fin elements to form a plurality of ice formation pockets. Processes for forming the assembly, as well as an ice machine incorporating the assembly, are also disclosed.

20 Claims, 4 Drawing Sheets

FIG. 1
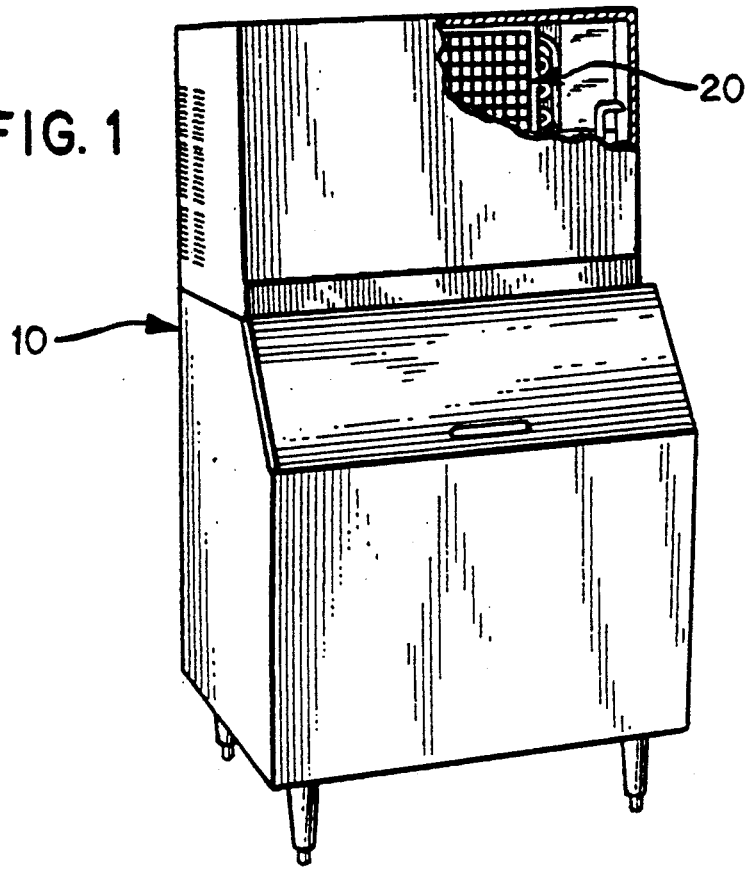
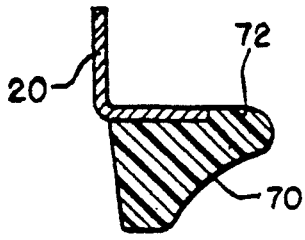
FIG. 8
FIG. 2
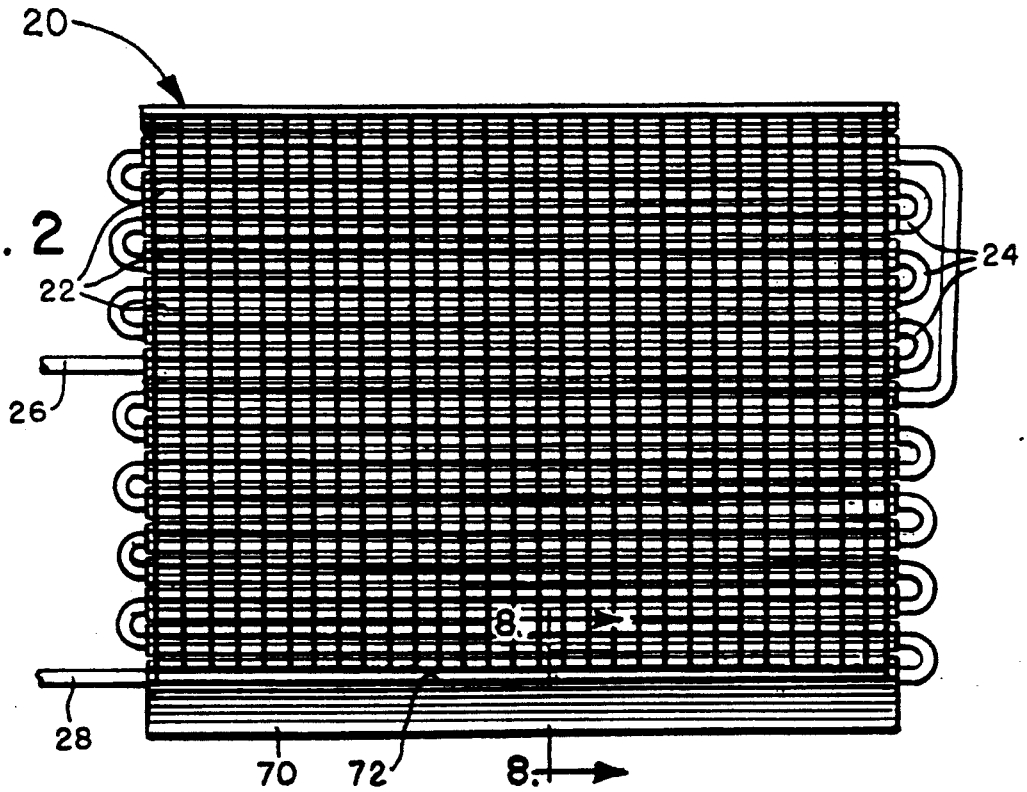

ICE MACHINE WITH IMPROVED EVAPORATOR/ICE FORMING ASSEMBLY

RELATED APPLICATIONS

This application is a continuation-in-part of U.S. patent application Ser. No. 07/534,926, filed Jun. 7, 1990, now abandoned.

BACKGROUND OF THE INVENTION

The present invention relates to automatic ice making machinery, and particularly to an improved, combined evaporator/ice forming assembly made from integral refrigeration tubing sections and ice forming pocket elements.

Automatic ice making machinery is commonplace. Ice machines are found in food service establishments, hotels and other places where large quantities of ice are needed on a continuing basis. Some ice machines produce flaked ice, while others produce ice cubes of a variety of shapes. The present invention relates to ice machines that make cubed ice.

Automatic cube ice machines generally comprise a refrigeration system (compressor, condenser and evaporator), a plurality of ice formation pockets (usually in the form of a grid of cells) and a water supply system. A typical ice machine has the evaporator section of the refrigeration system connected to the ice formation pockets so that the pockets are directly cooled by the refrigeration system. Water may either be supplied to fill the pockets in a static relationship, or may be trickled over or sprayed into the pockets, with the run-off being recirculated. When clear ice cubes are desired, the spray or trickle methods are used, since static freezing produces white ice.

In a typical cube ice machine, when the supply of previously created ice is insufficient, automatic controls cycle the machine through ice production and harvest modes. In the production mode, the refrigeration system operates in a normal manner, and expanding refrigerant in the evaporator section removes heat from the ice forming pockets, freezing the water to form an ever growing layer of ice. When the ice thickness reaches a preset condition, such as contacting an ice sensor, the machine goes into a harvest mode. Typically this involves a valve change so that hot refrigerant gases are directed to the evaporator section. The ice forming pockets are thus heated until the ice next to the pocket surfaces thaws. Weep holes are provided in each ice pocket (or cell) so that air is allowed to enter the back of the cell, preventing a vacuum from forming, allowing the ice to fall out the front of the cell. The valving in the refrigeration system is then changed back to its original configuration and the cycle repeats.

In some prior art cube ice machines, such as those disclosed in U.S. Pat. No. 3,280,588 to Brindley, the ice forming pockets are created by bonding evaporator tubes and partitions to a base wall. Such a structure, even if welded together, will not have a homogeneous cross section. The metal making up the original parts will have grain boundaries at the edges of the original parts. Even if disrupted during a welding process, the grain structure will evidence a welding of various parts.

Nickel- or tin-plated copper is most commonly used for the ice forming pockets in cube ice machines today. Such pockets may be formed by fitting notched strips of copper together in an "egg crate" relationship to form a grid of four sided pockets. The strips are then soldered to a backing pan. At the same time a serpentine piece of copper tubing (forming the evaporator section of the refrigeration system) can be soldered to the back of the pan. The entire evaporator/ice forming assembly is then nickel or tin plated. The plating is required by National Sanitation Foundation (NSF) codes, which prohibit the use of copper parts in contact with food products.

While plated copper assemblies work well in cube ice machines, they have several drawbacks. One of the primary problems is that the plating operation itself is costly, and typically produces sludge that is costly to dispose of in an environmentally safe manner. Also, copper is relatively expensive. Further, though it has very good heat conduction properties, copper is dense, so that it has a high heat capacity per unit volume. The duration of the production/harvest cycle is thus longer than desired because, at each change in the cycle, the copper ice forming pockets have to be either heated or cooled.

Another disadvantage of assemblies made from bonded parts, including plated copper assemblies, is that structures made from bonding different parts together usually suffer a heat transfer impediment. Usually, two elements may not be perfectly joined because the elements are not perfectly flat or otherwise matched in profile, and the presence of dust particles or oxides may cause surface irregularities decreasing thermal conduction at those locations. Further, because air has poor conducting properties, the presence of air pockets in two bonded elements may also reduce thermal conduction.

In attempting to overcome these disadvantages, a cast aluminum grid was experimented with. Cast aluminum was found to present several drawbacks. Primarily, even though the ice cube pockets could easily be formed in the casting, the evaporator system tubing had to be attached after the casting operation. This proved to be unworkable because the cast aluminum was so porous that the tubing could not suitably be brazed to the casting.

SUMMARY OF THE INVENTION

A combined evaporator/ice forming assembly for an ice machine has been invented that overcomes the above-identified problems. The assembly comprises evaporator tubing sections having one or more integrally formed fin elements; evaporator system connectors adapted for connecting the tubing sections together to form a sealed evaporator section of a refrigeration system; and divider elements adapted to fit together with the one or more fin elements to form a plurality of ice formation pockets.

In the preferred embodiment, the tubing/fin sections are made from extruded aluminum. Thus the material forming the one or more fin elements is homogeneous with the remainder of the tubing sections. The use of extruded aluminum parts simplifies the production process and increases the efficiency of the assembly by reducing the thermal resistance that normally exists in a bonded structure. Further, an extruded tubing/fin section lacks the grain boundary that are present in a brazed or welded tubing/fin construction.

The tubing/fin sections, the divider elements and the connector elements are preferably aluminum. Since aluminum has a lower heat capacity per unit volume than copper, the heat capacity of the assembly is reduced, providing faster change over between production and harvest modes. The aluminum does not require plating, is less expensive, and is lighter in weight than copper. The invention includes the novel assembly, the process for making the assembly, and the improved ice machine incorporating the assembly. The advantages of the invention, as well as the invention itself, will best be understood by reference to the drawings, a brief description of which is as follows.

BRIEF DESCRIPTION OF THE DRAWINGS

FIG. 1 is a perspective view of a cube ice machine incorporating the present invention, broken away in one corner to show the location of the evaporator/ice forming assembly.

FIG. 2 is an elevation view of the combined evaporator/ice forming assembly of the present invention as used in the ice machine of FIG. 1.

FIG. 8 is a sectional view taken along line 8—8 of FIG. 2.

DETAILED DESCRIPTION OF THE DRAWINGS AND PREFERRED EMBODIMENTS OF THE INVENTION

Figure 3:
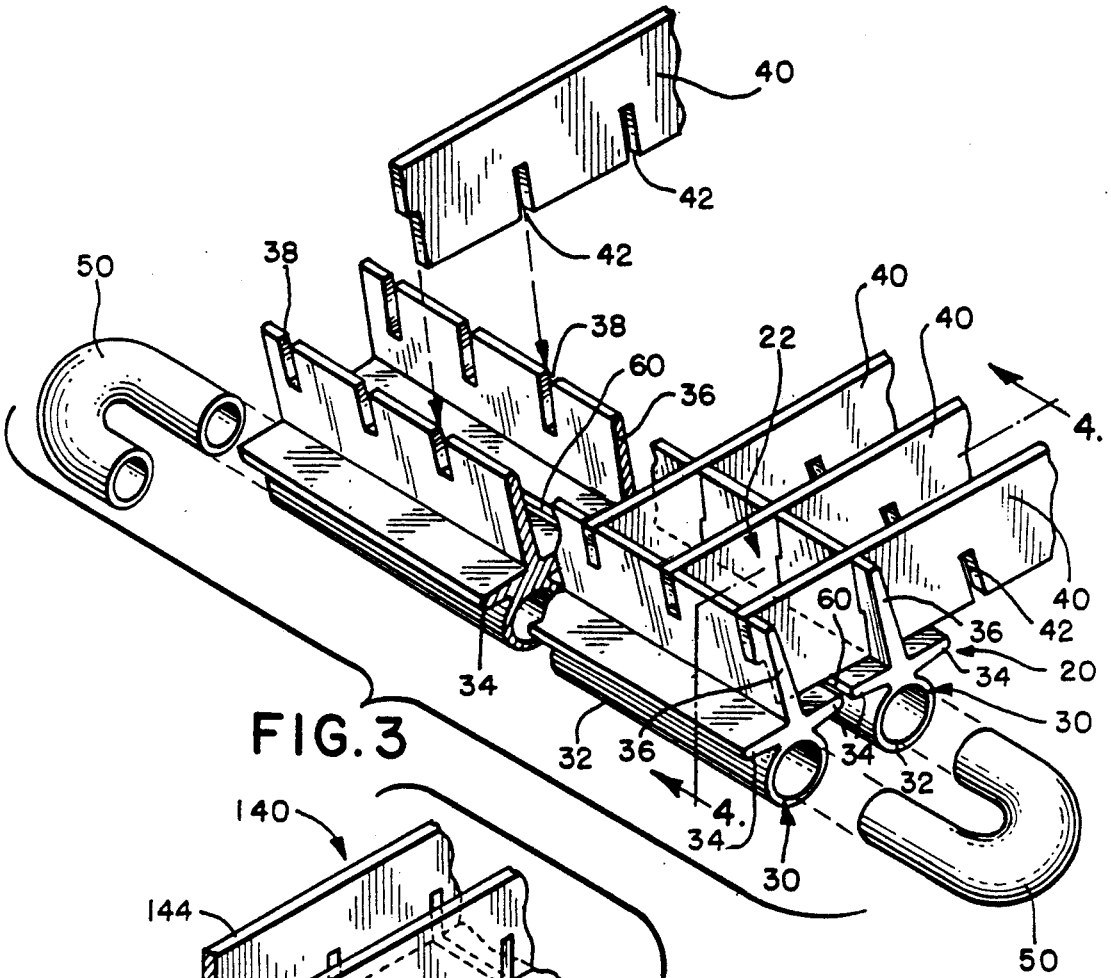
FIG. 3 is a perspective view of the preferred tubing extrusions and notched strip material used to form the assembly of FIG. 2.

FIG. 1 shows a cube ice machine 10. In this instance, the ice machine 10 is of conventional design, except it has been improved by using a unique combined evaporator/ice forming assembly 20. The assembly 20 fits in the upper part of ice machine 10, mounted in a vertical position, and is connected to compressor and condenser sections (not shown) of a refrigeration system and to a water supply system (not shown) all of which are conventional for cube ice machines. The lower part of the ice machine 10 comprises a storage bin into which ice produced in the top section is dumped during the harvest cycle.

As best seen in FIG. 2, the preferred assembly 20 includes a plurality of four-sided, ice formation pockets 22 arranged in vertical columns and horizontal rows. The pockets 22 are sloped down toward the front to aid in removal of ice during the harvest mode. Arranged in a serpentine fashion on the back of the grid of pockets 22 is the evaporator section 24 of the refrigeration system, where expanding refrigerant withdraws heat from the assembly 20. The refrigerant enters the assembly at the inlet 26 and leaves the assembly at the outlet 28.

In the first preferred embodiment, as best shown in FIGS. 3–6, the assembly 20 is made from extruded evaporator tubing sections 30 each comprising a tubing portion 32 and integrally formed fin elements. The extruded material is homogeneous throughout the tubing sections 30. The extruded material is characterized by the lack of a grain boundary that would be present if the fin elements were welded or brazed to the tubing sections. The homogeneous extruded evaporator tubing sections 30 avoid the impediment in thermal conductivity associated with bonded structures. As such, an extruded evaporator tube increases the efficiency of the assembly 20 as compared to a nonhomogeneous assembly.

Each tubing section 30 has two laterally extending fin elements 34 and one upstanding fin element 36. One of the lateral fin elements 34 from each of two adjacent tubing sections 30 form the back of an individual ice forming pocket 22. The upstanding fin element 36 forms one set of dividing walls (in this case the top and bottom walls) between pockets 22. The other set of dividing walls (on each side) between pockets 22 is formed by separate divider elements. The upstanding fin elements 36 extend at a non-perpendicular angle from the lateral fin elements 34. This provides the slope that allows ice formed in pockets 22 to more easily slide out of the upright assembly 20.

In the preferred embodiment shown in FIG. 3, the divider elements comprise a plurality of strips 40, each containing a plurality of notches 42. Notches 38 in upstanding fin elements 36 allow the strips 40, with cooperating notches 42, to fit together with the tubing sections 30 to form the plurality of ice formation pockets 22.

Figures 4, 5, 6:
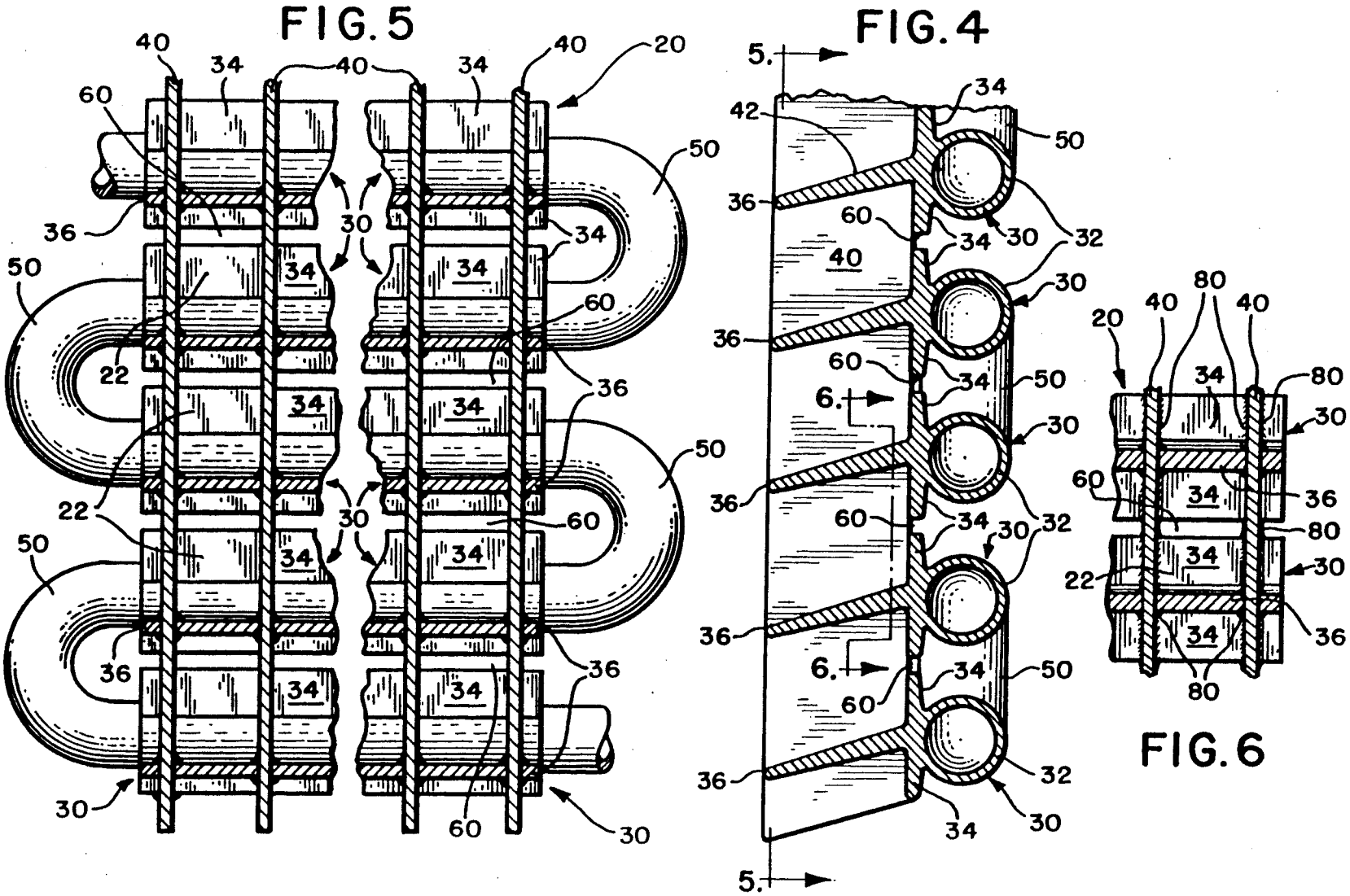
FIG. 4 is a sectional view taken along line 4—4 of FIG. 3.
FIG. 5 is a sectional view taken along line 5—5 of FIG. 4.
FIG. 6 is a sectional view taken along line 6—6 of FIG. 4, showing the typical location of brazing fill material after the brazing process.

In the preferred embodiment, U-shaped return bends 50 fit within the ends of adjacent tubing portions 32 and act as evaporator system connectors to form the sealed evaporator section 24 of the refrigeration system. As best shown in FIG. 5, the return bends 50 are attached between alternating pairs of tubing sections 32 on opposite ends of the assembly 20 to provide the serpentine nature of the evaporator 24.

The assembly 20 is easily constructed. Strips 40 and tubing sections 30 are fit together by notches 42 and 38. The ends of tubing portions 32 are sized slightly so that they will accept the return bends 50. (Preferably, the inside diameter of extruded tubing portions 32 is slightly less than the outside diameter of the return bends 50, and the tubing portions 32 are sized to allow 0.002 inches of clearance for fill by the brazing material.) Return bends 50 are next fit in place. Part of the assembly, strips 40, or the entire assembly is then brazed together by using a braze fill material and a flux, if needed.

Depending on the width of the lateral fin elements 34 and the spacing between notches 42, the back of each pocket 22 may have a gap 60 extending the direction of the tubing portions 32. If used, brazing filler material will fill in the gap 60 to some extent. However, preferably the gaps 60 are large enough to act as weep holes to allow air to enter the back of the pockets 22 during the harvest mode so that ice can fall out of the front of the pockets 22 without overcoming a vacuum formed by a film of water between the ice and the pocket walls. Of course, the gaps 60 should be small enough so that they quickly freeze-over. Weep holes could also be formed by drilling holes in the back of each pocket 22, or providing an area at the outside end of each notch 42 wider than the thickness of upstanding fin element 36.

Figure 7:
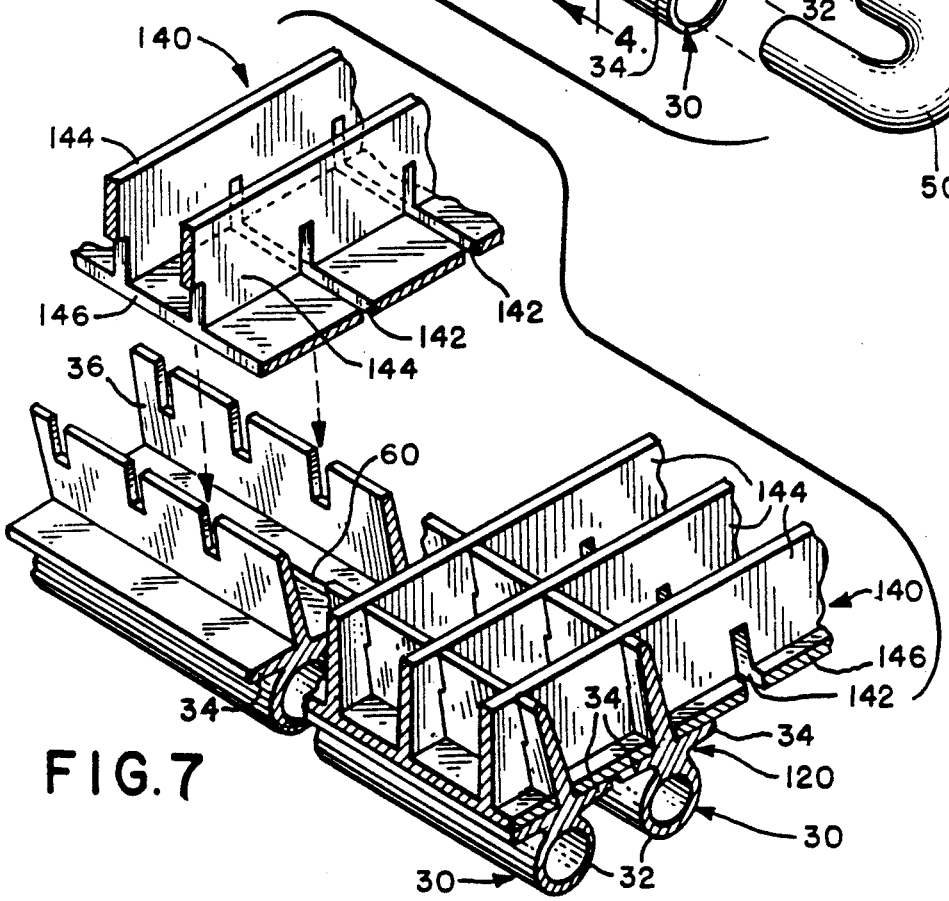
FIG. 7 is a perspective view of the preferred tubing extrusions mated with another extrusion replacing the notched strips, combined to form another embodiment of the invention similar to that shown in FIG. 3.

The assembly 120 shown in FIG. 7 is another embodiment of the invention. The assembly 120 may use the same tubing extrusions 30 as used in the assembly of FIGS. 3–6. However, instead of using a plurality of notched strips 40, the divider elements of the assembly 120 of FIG. 7 comprises one or more extrusions 140 containing a plurality of divider walls 144, each integrally formed with a base 146. The base 146 and divider walls 144 are notched with a plurality of notches 142 that allow the extrusion 140 to fit together with extruded tubing sections 30. In the embodiment of FIG. 7, the back of each pocket 22 is provided by the base 142. This base 142 seals the gap 60 between lateral fin elements 34 so that other weep holes must be provided, as discussed above. Just as with the embodiment of FIG. 3, return bends (not shown) may be used to seal the tubing portion 32 between extrusion tubing sections 30.

Figure 9:
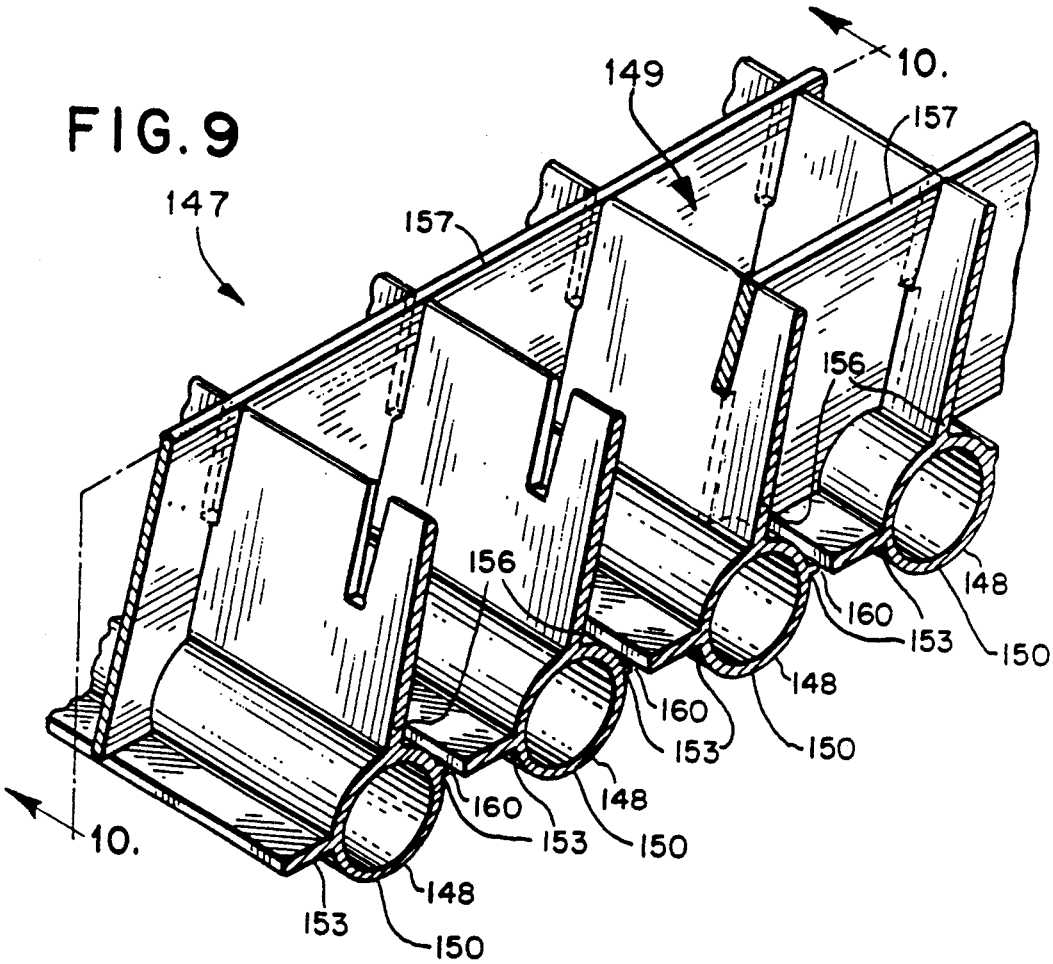
FIG. 9 is a perspective view of a section of an evaporator/ice forming assembly according to another embodiment of the present invention.
Figure 10:
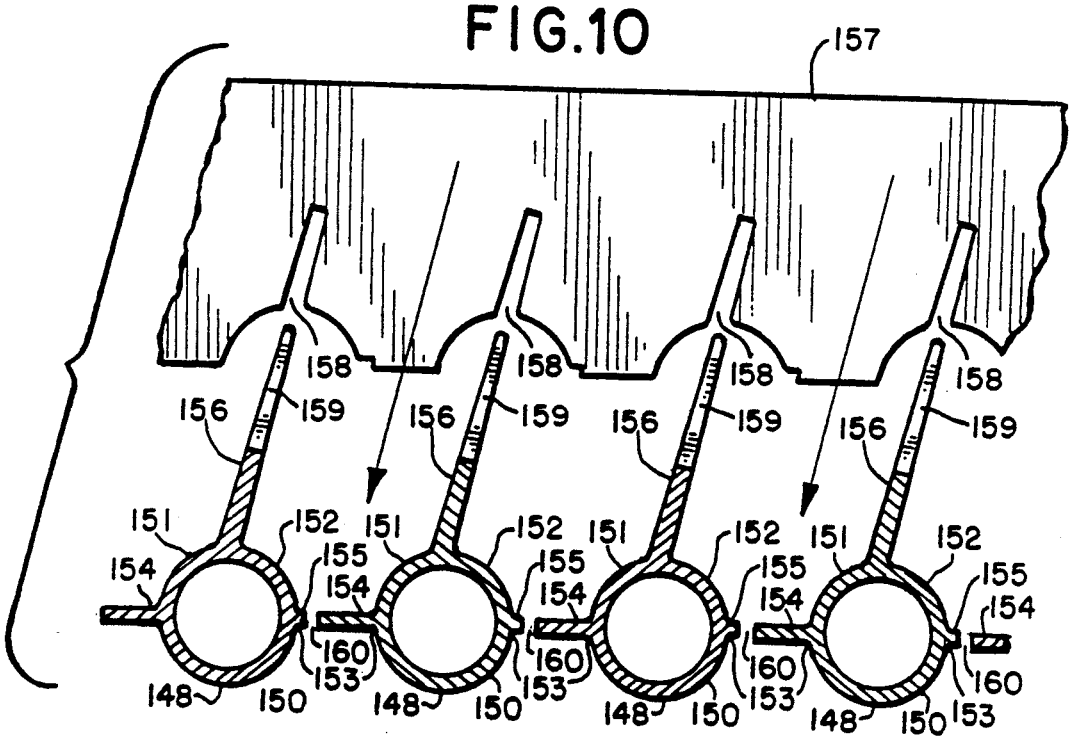
FIG. 10 is a sectional view taken along line 10—10 of FIG. 9.

FIGS. 9–10 show another preferred embodiment of the invention, made from assembly 147. This embodiment differs from the embodiments of FIGS. 1–7 in that a portion of the extruded evaporator tubing sections 148 acts as part of the wall of the ice forming pockets 149. This embodiment has more efficient heat transfer properties because portions of the tubing portions of the evaporator tubing sections 148 form part of the water-contact surface of the ice forming pockets 149, and are thus in direct thermal contact with the water or ice forming in pockets 149. Return bends (not shown) are used with tubing sections 148 to complete assembly 147, just as in the previous embodiments.

The assembly 147 is made from extruded evaporator tubing sections 148, each comprising a tubing portion (primary surfaces) 150 and integrally formed fins 154, 155 and 156 (secondary surfaces) extending substantially radially from tubing sections 148. The tubing portion 150 has surfaces 151 and 152 which form a part of the ice formation pocket 149. The radially extending fins 154, 155 and 156 are spaced circumferentially around tubing portions 150, as compared to all of the fins 34 and 36 extending from the same part of tube 32 (FIG. 4) in the previous embodiments. The lateral fin elements 154 and 155 extend opposite each other, and form the back of an individual ice pocket 149. Fin 154 is substantially longer than fin 155. The upstanding fin elements 156 and the evaporator tubing sections 148 form one set of dividing walls between the ice formation pockets 149. The other set of dividing walls between the ice formation pockets 149 are formed by a plurality of strips 157, each containing a cutout 158. Notches 159 in the upstanding fin elements 156 allow the strips 157, with cooperation of the notches 159, to fit together with the tubing sections 148 to form the ice formation pockets 149.

Just as in FIG. 3, FIGS. 9–10 show gaps 160 between lateral fin elements 154 and 155 that will be somewhat filled with brazing, if used, but will preferably leave weep holes large enough for air to enter the back of the pockets 149.

A number of brazing processes may be used to braze some or all of the elements of the evaporator/ice forming assembly 20 together. Brazing involves high temperature heating in the presence of a brazing fill material, and usually with a flux. Brazing creates a strong metallurgical bond, at the molecular level, between the surfaces being joined and the fill material. The brazing material is usually an aluminum alloy with a high silicon content to reduce its melting point. In the first preferred embodiment, the fill material is in the form of cylindrical rods or wire. Sections of the brazing filler are laid diagonally inside of each pocket 22, laying on the back surface of the pocket 22. A piece of brazing material is also fashioned into a ring around each joint between the return bends 50 and tubing portions 32. The brazing material melts and flows, by capillary action, to fill the various corners and joints of the assembly. FIG. 6 shows the typical location of fill material 80 after completion of the brazing process.

The flux is used to clean the surface and help the filler metal to flow into the joints. Aluminum has a hard oxide layer which needs to be cracked or removed for the filler metal to bond to the base metal under the oxide layer. The flux is believed to also help break up this oxide layer and permit the brazing material to flow underneath the oxides.

In the preferred brazing process, the flux used is Nocolok 100, sold by Kali-Chemie Corporation of Greenwich, CT. Nocolok 100 is a fluoride-based flux. Fluoride is the working base of many aluminum fluxes. However, Nocolok 100 flux is much lower in fluoride than most, and is considered very low in toxicity.

Nocolok 100 flux comes as a dry white powder. It is mixed with distilled water or alcohol and brushed or sprayed onto the aluminum using only a few grams (five to eight) per square meter. The flux runs down the side corners of the pockets 22 and flows into the joints between fin elements 34 or 36 and the notched strips 40. The flux is allowed to air dry, or may be dried in an oven at low temperature. The assembly 20 is then placed in an oven which is evacuated and charged back with a dry nitrogen atmosphere. The assembly 20 is heated to a brazing temperature in the range of 1070° F. to 1150° F., depending upon the alloys out of which the assembly parts are made. The heating time must be of sufficient duration to permit the filler to completely flow into the corners and joints of the assembly. Further, selection of a furnace depends on the geometry and size of the parts to be brazed as well as the production rates required. Gas cooling systems can be added to a vacuum furnace to achieve rapid cooling of the assembly.

After brazing, the flux residue may need to be washed off. The washing step is not necessary with Nocolok 100 flux since it is not corrosive like most other fluxes.

In this preferred brazing process, the preferred material for the extrusions 30, notched strips 40 and U-shaped return bends 50 is aluminum alloy 3003 (ANSI designation). The preferred brazing filler is brazing metal 4047 (ANSI designation). The notched strips 40 may be made from a braze-sheet aluminum which already incorporates a brazing filler. Braze-sheet is available with the filler metal clad to the base material. Cladding is done by putting two ingots of the materials together and rolling them into a sheet.

A second brazing process involves brazing the aluminum parts in a vacuum furnace with no air or other gas in the oven. In this process, no flux is needed; rather, magnesium acts to break the oxide surface of the aluminum. This may be accomplished by placing chips of magnesium in the oven near the part to be brazed, or the parts to be brazed may be made from alloys containing magnesium. It is thought by some that the magnesium in the base metal vaporizes and erupts through the aluminum oxide layer, physically breaking it. Others consider the magnesium chips alone to be sufficient. It is thought that the chips absorb the trace oxygen in the atmosphere and vaporize to react with the aluminum oxide.

Clad braze-sheet and foil are available with magnesium bearing braze alloys, although braze alloy without magnesium has been found to work if magnesium chips are located nearby.

In a third process, used for small scale and experimental work, Nocolok 100 flux is used in an electric heat treating type oven. The method differs from the first method because the temperature varies by about 100 degrees from the front to the back in this type of oven. First, nitrogen is used to purge the oven chamber before parts are placed inside. The Nocolok 100 flux is mixed with alcohol to allow it to be spread or sprayed onto the parts. It has been found that using flux levels well in excess of the optimum range described above has produced the best results in this less preferred oven.

The temperature in the oven is set to 1350° F. Thermocouples are mounted on the parts being brazed. The thermocouples are placed on the parts of the assembly that will be in the hottest part of the oven, the back corners. Two thermocouples are normally used for safety, and the higher in temperature of the two is used for controlling the process. The combined evaporator-/ice forming assembly 20 can be placed into the hot oven while the flux is still wet (the alcohol will burn off), although the process has also been successful in instances when the flux has dried before the assembly was placed into the oven.

When the thermocouple temperature rises to 1120° F., the power is cut and nitrogen flow is increased to slow the temperature rise. With one oven used, this took about ten minutes. When the temperature reaches 1150° F., the assembly is taken out and turned around so as to adequately heat the end of the assembly that has been in the cooler part of the oven. Power is turned back on, and the temperature cycle is repeated.

After the brazing operation, the assembly 20 may have to be coated to seal pin holes that might allow freezing water to damage the assembly. A coating can also be used to smooth the surfaces to allow easier ice release. A non-stick teflon type coating material may be suitable for both purposes.

With the preferred assembly 147 shown in FIGS. 9 and 10, it has been found that the brazing need only join the union of the fins 156, tubing portions 151 and 152, and strips 157. The back of the ice forming pockets, where strips 157 contact fins 154 and 155, need not be brazed.

One problem encountered in some conventional cube ice machines has been overcome in the preferred cube ice machine of the present invention. That problem resulted in lower than expected ice production. Upon investigation, it was discovered that instead of ice falling out of the front of the ice forming pockets, it stayed in the pockets and melted while the machine stayed in the harvest mode.

In the first preferred ice machine 10 of FIG. 1, as shown in FIGS. 2 and 8, a plastic member 70 is positioned under the vertical assembly 20. The front edge of the plastic member 70 is formed with a lip 72 which is about the same thickness as the divider element making up the bottom wall of each pocket 22 on the bottom row of assembly 20. When ice forms in the pockets 22, it also grows out over the edge of the divider elements, forming somewhat of a continuous sheet of ice on the face of the assembly 20. This sheet grows out, covering lip 72. During the harvest cycle, when the ice formation pockets are heated to release the ice, the lip 72 of plastic member 70, which does not heat up, holds up the sheet, and thus prevents the ice inside the pockets 22 from settling downward and continuing to melt in contact with the bottom wall of the ice formation pockets 22.

The dimensions and notch locations of the extruded tubing sections 30 (or 148), notched strips 40 (or 157) and return bends 50 will depend on the size of ice cubes to be formed in the assembly 20 (or 147). Preferably the fins 32 and 34 (or 154, 155 and 156) and strips 40 (or 157) will only be as thick as structurally necessary, since unnecessary material will negatively increase the thermal mass of the assembly 20 (or 147). The wall thickness of the tubing portions 32 (or 150) and return bends 50 will depend on the operating pressure of the refrigeration system, but again will be as thin as possible, of course taking into account necessary safety factors.

It should be appreciated that the apparatus and methods of the present invention are capable of being incorporated in the form of a variety of embodiments, only a few of which have been illustrated and described above. For example, the integral fin elements could form only the back of the ice-forming pockets 22, with separate horizontal and vertical divider elements provided to fit together with the fin elements to form the ice formation pockets 22. Whereas the extruded tubing sections 30 are shown as individual extrusions, more than one tubing section 30 and set of integral fin elements could be extruded together. Also, in the embodiment of FIGS. 9 and 10, fin 155 could be eliminated. Further, rather than using U-shaped return bends 50, headers could be connected to the tubing sections to form the sealed evaporator section of the refrigeration system. Further, the invention may be embodied in still other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

We claim:

1. A combined evaporator/ice forming assembly comprising:

a) evaporator tubing sections having one or more integrally formed fin elements, the material forming the one or more fin elements being homogeneous with the remainder of the tubing sections;

b) evaporator system connectors adapted for connecting the tubing sections together to form a sealed evaporator section of a refrigeration system; and c) divider elements adapted to fit together with said one or more fin elements to form a plurality of ice formation pockets wherein the one or more integrally formed fins comprise the back and two of the sides of the ice formation pockets.

2. The assembly of claim 1 wherein the evaporator tubing sections and integrally formed fin elements comprise one or more metal extrusions.

3. The assembly of claim 1 wherein the evaporator system connectors comprise U-shaped return bends.

4. The assembly of claim 1 wherein the divider elements comprise a plurality of notched strips.

5. The assembly of claim 1 wherein the material comprising the tubing section is aluminum.

6. The assembly of claim 1 wherein the ice formation pockets are four sided with a generally closed back and an open front, and wherein the fins comprising the sides are notched to cooperate with notched strips forming the remaining two sides of the pockets.

7. The assembly of claim 1 wherein a plurality of tubing sections and fin elements are integrally formed from one extrusion.

8. The assembly of claim 1 wherein portions of the tubing sections form part of the water-contact surface of the ice formation pockets and wherein the tubing sections have an upstanding fin element forming a dividing wall between the ice pockets.

9. The assembly of claim 1 wherein the fin elements extend at spaced locations from tubing portions of the tubing sections.

10. The assembly of claim 1 wherein the integrally formed fin elements extend substantially radially outward from tubing portions of the tubing sections.

11. The assembly of claim 6 wherein tubing portions of the evaporator tubing sections comprise at least part of one of the back and the two sides of the ice formation pocket.

12. The assembly of claim 1 wherein a portion of tubing portions of the evaporator tubing sections is configured and positioned to be in direct thermal contact with water or ice in the ice formation pocket.

13. The combined evaporator/ice forming assembly as recited in claim 1 further comprising:

a) the evaporator tubing sections having an annular cross-section tubing portion;

b) evaporator system connectors adapted for connecting the tubing sections together to form a sealed evaporator section of a refrigeration system; and c) divider elements adapted to fit together with said one or more fin elements to form a plurality of ice formation pockets wherein a portion of the outside surface of said tubing portion forms part of the water-contact surface of the ice formation pockets.

14. An improved ice machine comprising a refrigeration system, a plurality of ice formation pockets cooled by said refrigeration system and a water supply system for supplying water to said ice formation pockets, the improvement comprising a combined evaporator/ice forming assembly comprising:

a) evaporator tubing sections having one or more integrally formed fin elements, the material forming the one or more fin elements being homogeneous with the remainder of the tubing section, b) evaporator system connectors adapted for connecting the tubing sections together to form a sealed evaporator section of the refrigeration system, and c) divider elements adapted to fit together with said one or more fin elements to form a plurality of ice formation pockets wherein the one or more integrally formed fins comprise the back and two of the sides of the ice formation pockets.

15. A combined evaporator/ice forming assembly comprising:

a) evaporator tubing sections having one or more integrally formed fin elements, b) evaporator system connectors adapted for connecting the tubing sections together to form a sealed evaporator section of a refrigeration system, c) divider elements adapted to fit together with said one or more fin elements to form a plurality of ice formation pockets; and d) weep holes comprising gaps between adjacent sections of the integrally formed tubing and fin sections in order to allow air to enter each of the ice formation pockets during the removal of ice from the pockets.

16. An improved ice machine comprising a refrigeration system, a plurality of ice formation pockets cooled by said refrigeration system and a water supply system for supplying water to said ice formation pockets, the improvement comprising:

a) a vertically positioned combined evaporator/ice forming assembly comprising:

i) evaporator tubing sections having one or more integrally formed fin elements, ii) evaporator system connectors adapted for connecting the tubing sections together to form a sealed evaporator section of the refrigeration system, and iii) divider elements adapted to fit together with said one or more fin elements to form a plurality of ice formation pockets; and b) a plastic member under the assembly shaped and positioned such as to support the front face of the ice formed in the ice formation pockets such that during a harvest cycle, wherein the ice formation pockets are heated to release the ice, the plastic member prevents the ice from continuing to contact the ice formation pockets once the ice has started to melt.

17. An improved ice machine comprising a refrigeration system, a plurality of ice formation pockets cooled by said refrigeration system and a water supply system for supplying water to said ice formation pockets, wherein the ice formation pockets are positioned vertically, the improvement comprising a plastic member under the ice formation pockets shaped and positioned such as to support the front face of the ice formed in the ice formation pockets such that during a harvest cycle, wherein the ice formation pockets are heated to release the ice, the plastic member prevents the ice from continuing to contact the ice formation pockets once the ice has started to melt.

18. The ice machine of claim 17 wherein the ice formation pockets are part of an assembly, the assembly also comprising an evaporator section of the refrigeration system.

19. The ice machine of claim 18 wherein the evaporator section of the refrigeration system comprises tubing sections formed as one piece with one or more fin elements, and wherein the fin elements in part comprise the ice formation pockets.

20. A combined evaporator/ice forming assembly comprising:

a) evaporator tubing sections having one or more integrally form fin elements, each tubing section and integral one or more fin elements being formed together as one piece, b) evaporator system connectors adapted for connecting the tubing sections together to form a sealed evaporator section of a refrigeration system, and c) divider elements adapted to fit together with said one or more fin elements to form a plurality of ice formation pockets wherein the one or more integrally formed fins comprise the back and the sides of the ice formation pockets.

* * * * *